United States Patent [19]

Hindes

[11] Patent Number: 4,655,036

[45] Date of Patent: Apr. 7, 1987

[54] TWO-TANK WORKING GAS STORAGE SYSTEM FOR HEAT ENGINE

[75] Inventor: Clyde J. Hindes, Troy, N.Y.

[73] Assignee: Mechanical Technology Incorporated, Latham, N.Y.

[21] Appl. No.: 837,368

[22] Filed: Mar. 7, 1986

[51] Int. Cl.[4] ..... F02G 1/06

[52] U.S. Cl. ..... 60/521; 60/517

[58] Field of Search ..... 60/517, 521, 522, 525

[56] References Cited

U.S. PATENT DOCUMENTS

| | | | |
|---|---|---|---|
| 3,820,330 | 6/1974 | Hakansson | 60/521 |
| 4,601,171 | 7/1986 | Stotts | 60/521 |
| 4,612,769 | 9/1986 | Berntell | 60/521 |

*Primary Examiner*—Stephen F. Husar

*Attorney, Agent, or Firm*—Joseph V. Claeys

[57] ABSTRACT

A two-tank working gas supply and pump-down system is coupled to a hot gas engine, such as a Stirling engine. The system has a power control valve for admitting the working gas to the engine when increased power is needed, and for releasing the working gas from the engine when engine power is to be decreased. A compressor pumps the working gas that is released from the engine. Two storage vessels or tanks are provided, one for storing the working gas at a modest pressure (i.e., half maximum pressure), and another for storing the working gas at a higher pressure (i.e., about full engine pressure). Solenoid valves are associated with the gas line to each of the storage vessels, and are selectively actuated to couple the vessels one at a time to the compressor during pumpdown to fill the high-pressure vessel with working gas at high pressure and then to fill the low-pressure vessel with the gas at low pressure. When more power is needed, the solenoid valves first supply the low-pressure gas from the low-pressure vessel to the engine and then supply the high-pressure gas from the high-pressure vessel. The solenoid valves each act as a check-valve when unactuated, and as an open valve when actuated.

5 Claims, 6 Drawing Figures

TWO-TANK WORKING GAS STORAGE SYSTEM FOR HEAT ENGINE

The Government of the United States of America has rights in this invention pursuant to Contract No. DEN3-32 awarded by the U.S. Dept. of Energy.

BACKGROUND OF THE INVENTION

This invention relates to a hot gas engine and, in particular, to controlling the operation of a Stirling engine suitable for use in an automotive application.

The Stirling or hot gas engine cycle is well known in the art. A two-cylinder Stirling engine is described in U.S. Pat. Nos. 3,984,983 and 3,999,388, while a four cylinder engine is further described in U.S. Pat. Nos. 3,914,940 and 4,474,003. The Stirling engine is durable, clean burning, and exhibits relatively high efficiency when compared to the more conventional internal combustion engine. The Stirling engine, however, is relatively slow to respond to changes in power demands and thus difficult to adapt for use in motor vehicles where engine acceleration and deceleration must be rapid. Recently, efforts have been undertaken to improve the response time of the Stirling engine so that it might be better suited for use in motor vehicles.

In the hot gas engine, one method of regulating the engine power output is by changing the pressure of a working gas, favorably a light gas such as helium or hydrogen, contained within the engine. To increase the engine's output power, the internal gas pressure is increased by adding gas to the engine from an external supply reservoir. To decrease the engine pressure, gas is typically pumped from the engine back to the supply reservoir using a compressor.

Single acting or double acting compressors are generally used to pump down the hot gas engine. In either case, the compressor has a single capacity. In order to attain a satisfactory idle pressure, which is usually about four megapascals, or MPa, the capacity of the compressor must be relatively low. As a consequency, the pump down rate of the engine is correspondingly slow, and the time required to bring the engine pressure from some high operating value to idle can be far too long for efficient use in an automotive application. The portion of the engine gas that cannot be pumped by the limited capacity compressor is short-circuited back to the engine. The energy contained in the short-circuited gas is dissipated in the engine and represents lost power, thereby reducing engine efficiency. This type of efficiency penalty can be relatively large and can only be minimized by increasing the pump down rate.

The system of U.S. Pat. No. 3,782,119 does not include a compressor. The natural pressure wave of the Stirling power cycle is utilized to increase or decrease the gas pressure. A series of supply tanks are provided, each of which is maintained at a different pressure. Through use of a control valve, one or more of the tanks can be connected to the engine to raise the engine pressure to some desired level. During pressure reduction, the engine working gas is bled back into tanks, again selectively sequencing the control valves. The valving scheme, by necessity, must be rather complex and maintaining close control over the tank pressures is sometimes difficult. For smooth operation, care must be taken that the appropriate valves are opened and closed at the proper times. Furthermore, the response of the engine without the aid of a compressor is relatively slow.

In pumping down to idle pressure, the compressor can have a working gas pressure at the output side many times what it is at the suction side. However, for optimum operation, this ratio of output to suction should not exceed about four for a single stage compressor. Even so, the same compressor must still be able to deliver pump down working gas to the storage tank at a heavy motor load condition, at idle, and over a broad range of power load conditions in between.

OBJECTS AND SUMMARY OF THE INVENTION

It is therefore an object of this invention to provide a working gas control system for a hot gas engine that avoids the problems of the prior art.

It is a further object of this invention to provide a working gas supply and storage system which facilitates supply and pumpdown of the working gas over a broad power range and is responsive to changes in power demand.

It is a still further object of this invention to improve the efficiency of a hot-gas engine by efficient control of working gas pressure so as to avoid unnecessary loss of energy in the form of waste heat.

It is yet another object of this invention to provide a multiple-tank supply system in which the switchover from a tank at one pressure to a tank at another pressure occurs smoothly and substantially without interruption.

In accordance with an aspect of the invention, a two-tank working gas handling system is coupled to a hot gas engine, such as a Stirling engine. The system has a power controller for admitting the working gas to the engine when increased engine power is needed and for releasing the working gas from the engine when engine power is to be decreased. A compressor pumps the working gas that is released from the engine. Two storage vessels or tanks are provided, one for storing the working gas at a modest pressure (i.e., about half maximum engine pressure), and another for storing the working gas at a higher pressure (i.e., about full engine pressure). These pressures can be about 10 MPa and 20 MPa, respectively, in a typical Stirling engine. Solenoid valves are associated with the gas lines to each of the storage vessels and are selectively actuated to couple the vessels one at a time to the compressor during pump down to fill the high-pressure vessel with working gas at high pressure and then to fill the low-pressure vessel with the gas at low pressure. When more power is needed, the solenoid valves first supply low-pressure gas from the low-pressure vessel to the engine and then supply the high-pressure gas from the high-pressure vessel.

In a favorable embodiment, the low-pressure solenoid valve is configured to have a first or open position and a second or check-valve position, the latter passing gas from the low-pressure vessel to the engine, and the high-pressure solenoid valve is configured to have a first or open position and a second or check-valve position, the latter passing gas only in the direction from the compressor to the high-pressure vessel. The actuation of these solenoid valves is carried out by a power control circuit in response to the pressure of the working gas in the engine and in accordance with the power demand to the engine. The valve design featuring check-valve action in their second positions (which is favorably the unactuated position) achieves substantially instantaneous switchover from the low-pressure to the high-pressure vessel when gas is supplied to the engine, and from the high-pressure to the low-pressure vessel during pumpdown.

The above and many other objects, features, and advantages of this invention will become apparent from the ensuing detailed description of a preferred embodiment of the invention, which is given as an example and not for purposes of limitation, which description should be read in conjunction with the accompanying drawing.

DETAILED DESCRIPTION OF THE PREFERRED EMBODIMENT

Figure 1:
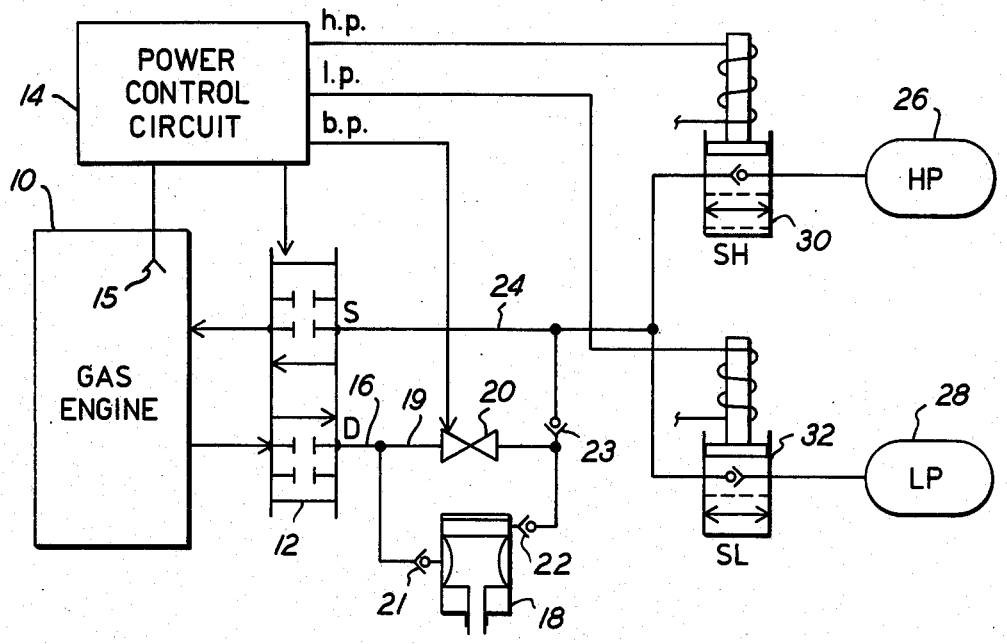
FIG. 1 is a schematic diagram of a working gas pressure control system for a hot gas engine in accordance with an embodiment of this invention.

With reference initially to FIG. 1, there is shown a diagram of a hot gas engine 10 of a conventional and well-known design utilizing the Stirling power cycle to develop usable output power. Accompanying the engine 10 is a mean pressure control system which, in conjunction with the engine 10, embodies the teachings of the present invention. As will become apparent from the following disclosure, the system of this invention has wide applicability to the automotive field because of, among other things, its rapid responsiveness to changes in accelerator settings and its ability to achieve idling pressures more easily than other systems that are known in the art.

The system of this invention employs a power control valve 12 of the type having three positions, to wit, a neutral position as shown in FIG. 1, a supply position (FIGS. 2 and 3) in which working gas is supplied to the engine 10, and a dump position (FIGS. 4 and 5) in which the working gas is drawn out from the engine 10. The position of the valve 12 is controlled by a power control logic circuit 14, which can be of suitable design to carry out its functions as described herein. This circuit 14 has a working gas pressure sensor 15 in communication with the gas engine 10.

The valve 12 has a dump output D connected to discharge line 16, such that the latter is coupled to the engine 10 when the valve 12 is in the dump position, and this line 16 supplies the working gas to a compressor 18, which can be of conventional or known construction. A bypass line 19 having a bypass valve 20 is coupled between the intake or suction port and output or pressure port of the compressor 18 and intake check valve 21 is placed in line between the line 16 and the suction port of the compressor 18, and another check valve 22 is disposed at the pressure or output port of the compressor 18 and in advance of the bypass line 19. A discharge check valve 23 connects the compressor 18 to a supply line 24, which is coupled to a supply input S of the valve 12, and to both a high-pressure tank or vessel 26 and low-pressure tank or vessel 28 through respective solenoid 2-position valves 30 and 32. The power control circuit 14 supplies control signals HP and LP to control the solenoid valves 30 and 32 respectively, and also supplies a control signal BP to open and close the bypass valve 20. These signals are produced in the power control circuit 14 in accordance with the working gas pressure in the engine 10 and also in response to data from various other sources relating to the operating conditions of the engine 10, for example, from an accelerator switch (not shown). Alternatively, compressor 18 may be controlled by means of an electric motor, magnetic clutch, or other suitable means, the operation of which would be made responsive to the control signal BP from power control circuit 14. If such alternate control is used, bypass line 19, bypass valve 20, and discharge check valve 23 would be omitted.

The supply line 24 is common to the two tanks 26 and 29. It should be noted that the solenoid valve 30 associated with the high-pressure tank or vessel 26, in its unactuated position acts as a one-way or check valve, which opens to admit gas to the tank 26, but blocks the flow of gas from the tank 26 to the supply line 24. Its other, or actuated position, the valve 30 is open, and permits the free flow of gas from the tank 26 to the supply line 24. The valve 32, similarly to the valve 30, in its unactuated position serves as a check check valve permitting gas to flow from the low pressure tank or vessel 28 to the supply line 24, but blocking the flow of high-pressure gas into the tank 28. In its actuated position, the valve 32 permits the free flow of gas to or from the tank 28.

Thus, the solenoid valves 30 and 32 as employed in this invention are two-way, normally-closed, pilot-operated type valves, which have the unique feature that, when not energized or actuated, they function as check valves, that is, closed to flow in one direction, but open in the reverse flow direction. The solenoid valves thus have two functional roles: when energized they function as open valves, allowing flow in either direction; when deenergized, they permit flow in the "reverse" direction, but do not permit gas flow in the other direction.

With the valve 12 arranged as in FIG. 1, the Stirling or other gas engine 10 and the gas storage system are in the neutral position. Here, no working gas is added to or drawn from the engine 10, and the compressor 18 is bypassed by the bypass line 19 and valve 20; thus, no gas flows to or from the tanks 26, 28, and the solenoid valves 30 and 32 are not actuated.

Figure 2:
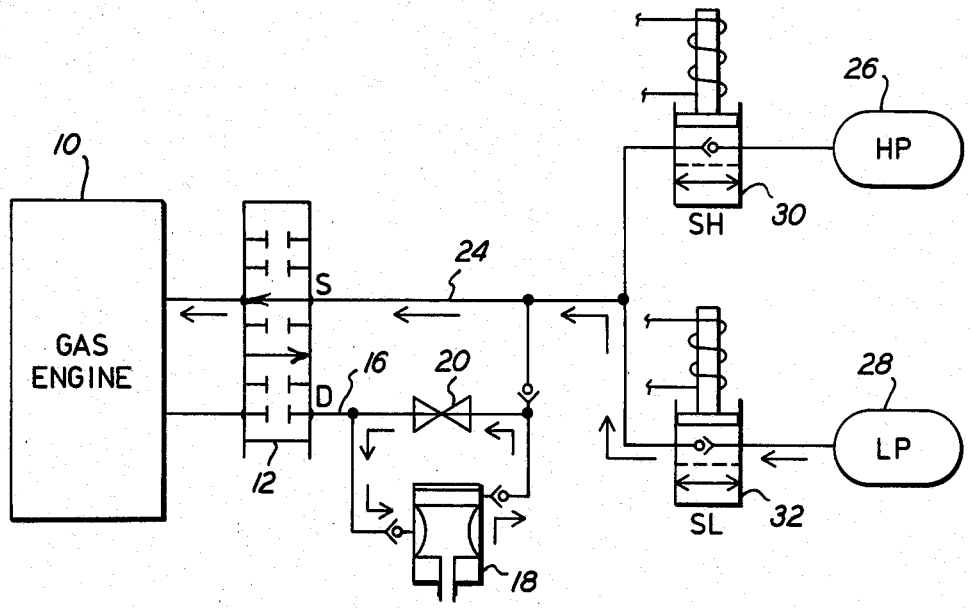
FIGS. 2–5 are schematic diagrams of the working gas pressure control system of FIG. 1, respectively showing the stages of low-pressure gas supply, high-pressure gas supply, high-pressure gas pumpdown, and low-pressure gas pumpdown.
Figure 3:
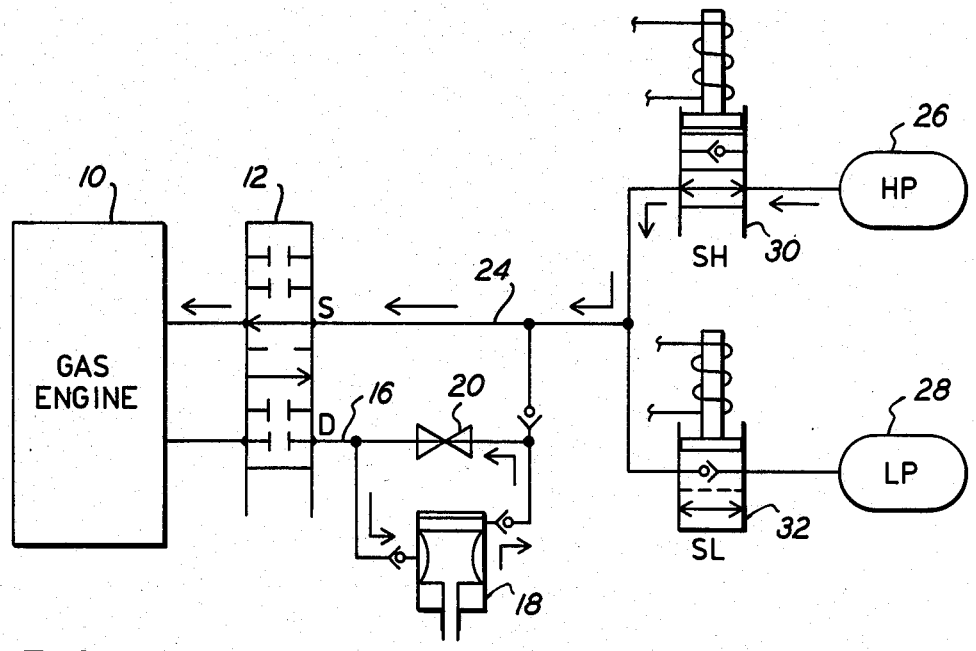

When the gas engine 10 is accelerated from an idle, an initial supply condition is achieved, as shown, for example, in FIG. 2. Here, in the initial supply mode, the valve 12 is moved to its supply position, and the solenoid valves 30 and 32 remain unactuated. In this mode, the working gas in the low-pressure vessel 28 has a higher pressure than the engine 10, so gas flows through the check-valve part of the low-pressure solenoid valve 32, through the supply line 24 and the control valve 12, to the engine 10. The gas in the high-pressure tank 26 is at a higher pressure than the gas being supplied through the supply line 24, so the check-valve side of the high-pressure solenoid valve 30 remains closed. This initial supply mode will be continued until the working gas pressure of the engine 10 and the tank pressure of the low-pressure vessel 28 are approximately equal. Then, the solenoid valve 30 is actuated to establish an increased supply mode, as shown in FIG. 3. Here, in the increased supply mode of FIG. 3, the engine power control logic circuit 14 has determined that the engine 10 should have a working pressure at some predetermined pressure level greater than the pressure of the low-pressure vessel 28. Thus, the circuit 14 generates the control signal HP to actuate the high-pressure solenoid valve 30, but the low-pressure solenoid valve 32 remains unactuated. Gas flows from the tank 26 through the valve 30 and the supply line 24 into the gas engine 10, but, because this working gas is at a higher pressure than the gas in the low-pressure vessel 28, the check-valve part of the low-pressure solenoid valve 32 remains closed. Gas continues to flow from the high-pressure vessel 26 into the engine 10 until the solenoid 30 is deenergized or until the engine pressure equals the pressure of the high-pressure vessel 26. In practice, the valve 12 would also normally be moved to its neutral position before the maximum pressure is reached in the engine 10.

Once the ideal working gas pressure has been achieved in the engine 10, the power control circuit 14 will place the elements into the neutral configuration shown in FIG. 1, until such time as the engine must be decelerated or its load removed.

Figure 4:
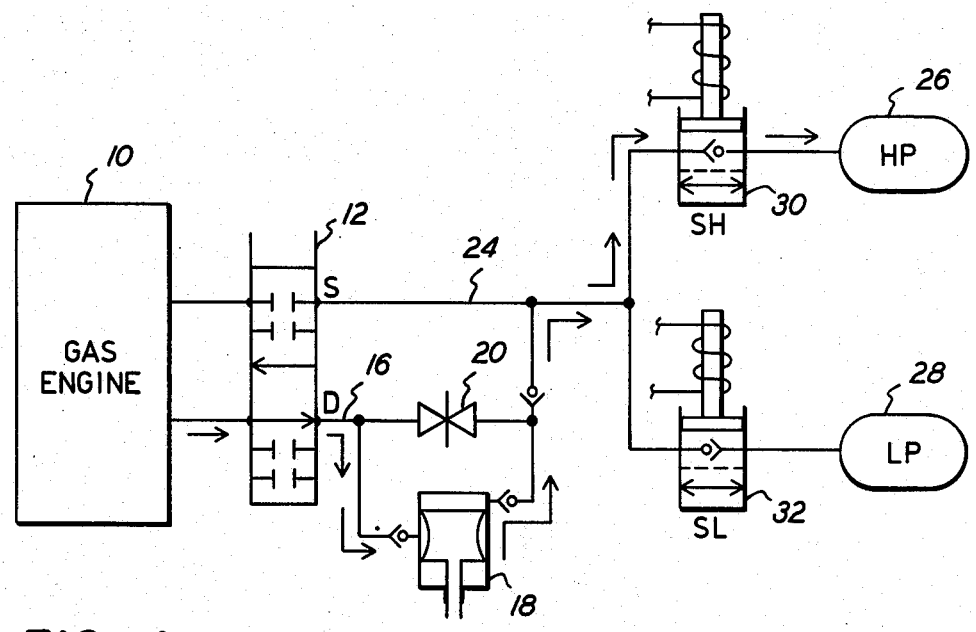

When the engine 10 goes from a high-performance, high power mode back to a low-power mode or to idle, an initial pumpdown mode is selected, as shown in FIG. 4. As depicted there, during initial pumpdown, the pressure control valve 12 is moved to its dump position, and the compressor bypass valve 20 is opened. The compressor 18 pumps the working gas from the engine 10, through the check-valve part of the unactuated, unenergized high-pressure solenoid valve 30, into the high-pressure vessel 26. The low-pressure solenoid valve 32, which is unenergized and unactuated at this time, acts as a blocking check valve.

Figure 5:
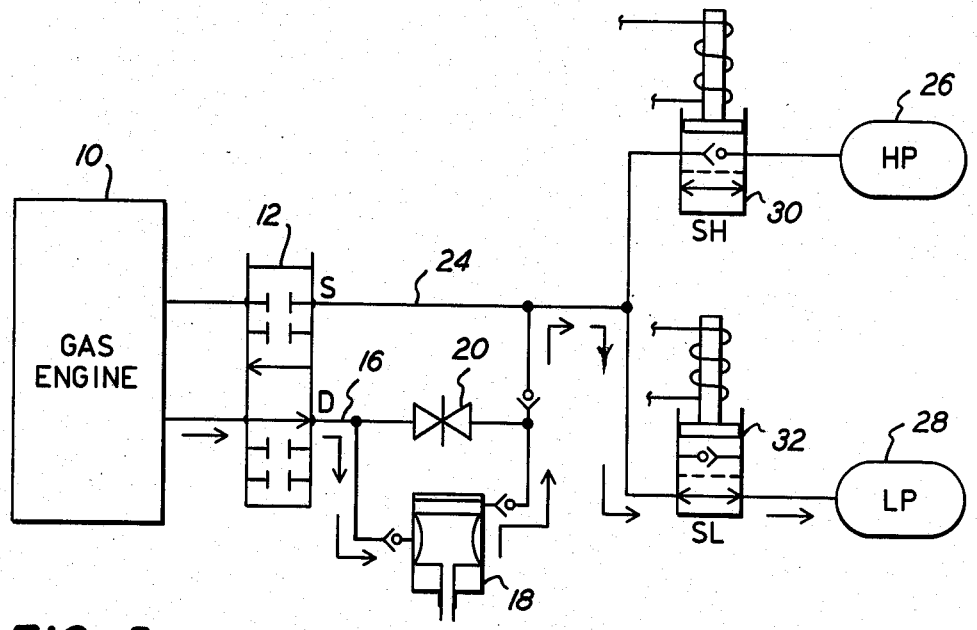

At some predetermined pressure, the low-pressure solenoid valve 32. is actuated, as shown in FIG. 5, and the working gas is pumped from the engine 10, through the actuated solenoid valve 32 into the low-pressure tank 28. The pressure control valve 12 remains in its dump position, and the high-pressure solenoid valve 30 functions as a closed check valve.

The selector logic table as presented herebelow, indicates the positions of the pressure control valve 12, the compressor by-pass valve 20, and the solenoid valves 30 and 32.

The system as depicted here has the following unique advantageous features:

The transition from the initial supply mode to increased supply mode, the switchover from the low-pressure tank 28 to the high pressure tank 26 is substantially instantaneous with the opening of the high-pressure solenoid valve 30. In a conventional arrangement, on the other hand, a time lag would have to be calculated in, to compensate for the time when both valves 30 and 32 would be closed, in order to prevent the high-pressure gas from the vessel 26 from bleeding into the low-pressure vessel 28. Also, during the pumpdown cycle, the switchover from the high pressure tank 26 to the low-pressure tank 28 is also substantially instantaneous, and there is no time lag needed during switchover, thus avoiding "dead heading" of the compressor 18. Because of the above two features, the point at which the solenoid valves 30 and 32 are actuated is not critical, so long as there is no time when both solenoid valves 30 and 32 are open at the same time.

Figure 6:
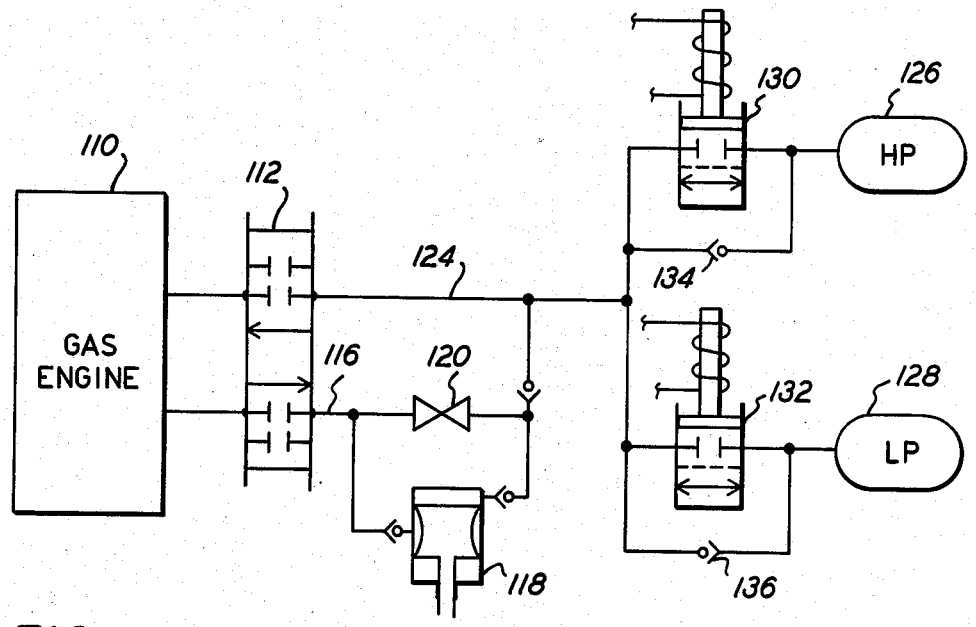
FIG. 6 is a schematic diagram of an alternative arrangement according to this invention.

An alternative version of this system is illustrated in FIG. 6, in which like elements are identified with the same reference numbers as in FIG. 1, but raised by 100. Here, the solenoid valve 30 for the high-pressure tank 126 has been replaced with an on/off type valve 130, which has connected in parallel with it a check valve 134. Similarly, the solenoid valve 32 has been replaced with an on/off valve 132 and a check valve 136 in parallel with it. The operation of the FIG. 6 embodiment would be substantially the same as that of the embodiment of FIGS. 1–5.

While the invention has been described in detail with respect to a preferred embodiment, it should be understood that many modifications and variations, thereof would be possible without departure from the scope and spirit of this invention, which is to be measured from the appended claims.

I claim

1. In a working gas control system for use in connection with a hot gas engine including a power controller for admitting the working gas to the engine to increase engine power and for releasing working gas from the engine to decrease engine power, a compressor for compressing the working gas released from said engine, a plurality of storage vessels for storing said working gas received from the compressor and supplying said gas through the power controller to said engine, each said vessel storing the working gas at a different pressure, and valve means for selectively coupling said vessels to said controller and selectively coupling said vessels to said compressor so that the selected vessel can supply said working gas to the engine or receive the gas from the compressor, and respective gas lines connecting said valve means with said compressor and said power controller; the improvement wherein said vessels include a high pressure vessel and a low pressure vessel, said valve means includes a low-pressure solenoid two-position valve on the line to said low pressure vessel, a first position permitting flow of said gas in either direction, a second position permitting flow only in the direction towards said engine; and a high-pressure solenoid two-position valve on the line to said high-pressure vessel, one position permitting flow of said gas in either direction, the other position permitting flow only in the direction towards said high-pressure vessel.

2. The working gas control system of claim 1 further comprising control means for sensing the engine working gas pressure and sequencing actuation of said high-pressure and low-pressure two-position valves and said controller, so that when more working gas is to be supplied to the engine, said gas is supplied first from said low-pressure vessel through said low-pressure valve in its second position and then from said high-pressure vessel through said high-pressure valve in its first position, and so that when working gas is to be drawn from the engine and stored, said gas is supplied from said compressor through said high-pressure valve in its second position to said high-pressure vessel, and then through said low-pressure valve in its first position to said low-pressure vessel.

3. The working gas control system of claim 2 wherein said high-pressure and low-pressure two-position valves each include a check valve connecting the respective vessel to the gas line in said second positions.

4. The working gas control system of claim 2 wherein said high and low-pressure vessels are at substantially 20 and 10 MPa, respectively.

5. The working gas control system of claim 2 wherein said power controller has a supply position, a discharge position, and a neutral position, and said control means actuates said solenoid valves and selects the position of said power controller.

* * * * *